United States Patent [19]

Jacob et al.

[11] Patent Number: 4,642,840

[45] Date of Patent: Feb. 17, 1987

[54] HOUSING FOR A VACUUM CLEANER

[75] Inventors: Gernot Jacob, Weissach-Flacht; Leon Radom, Ellhofen, both of Fed. Rep. of Germany

[73] Assignees: Progress-Elektrogeräte Mauz; Pfeiffer GmbH & Co., both of Nürtingen, Fed. Rep. of Germany

[21] Appl. No.: 779,364

[22] Filed: Sep. 23, 1985

[30] Foreign Application Priority Data

Sep. 27, 1984 [DE] Fed. Rep. of Germany ..... 3435503

[51] Int. Cl.[4] ..... A47L 9/00

[52] U.S. Cl. ..... 15/323; 15/327 E; 15/327 F

[58] Field of Search ..... 15/327 R, 327 E, 323, 15/327 F

[56] References Cited

U.S. PATENT DOCUMENTS

| | | | |
|---|---|---|---|
| 2,641,330 | 6/1953 | Lofgren et al. | 15/323 X |
| 2,764,225 | 9/1956 | Beede | 15/323 X |
| 3,029,462 | 4/1962 | Tamarin | 15/323 |
| 4,545,089 | 10/1985 | Oxel | 15/323 |

FOREIGN PATENT DOCUMENTS

| | | | |
|---|---|---|---|
| 2400347 | 7/1975 | Fed. Rep. of Germany | 15/323 |
| 2638639 | 3/1978 | Fed. Rep. of Germany | 15/323 |
| 1539512 | 8/1968 | France | 15/323 |

*Primary Examiner*—Chris K. Moore

*Attorney, Agent, or Firm*—Kline, Rommel & Colbert

[57] ABSTRACT

Housing for a hand vacuum cleaner, the stowage chamber in the bottom portion of the housing being made by a cavity in the housing wall for formfit holding of the accessory part and in its longitudinal dimensions being arranged perpendicular to the longitudinal axis of the housing, and the stowage chamber being integrated in the baffle and at least partially projecting into the dust chamber, the endless seal extending over the upper wall of the stowage chamber.

6 Claims, 2 Drawing Figures

HOUSING FOR A VACUUM CLEANER

Figure 1:
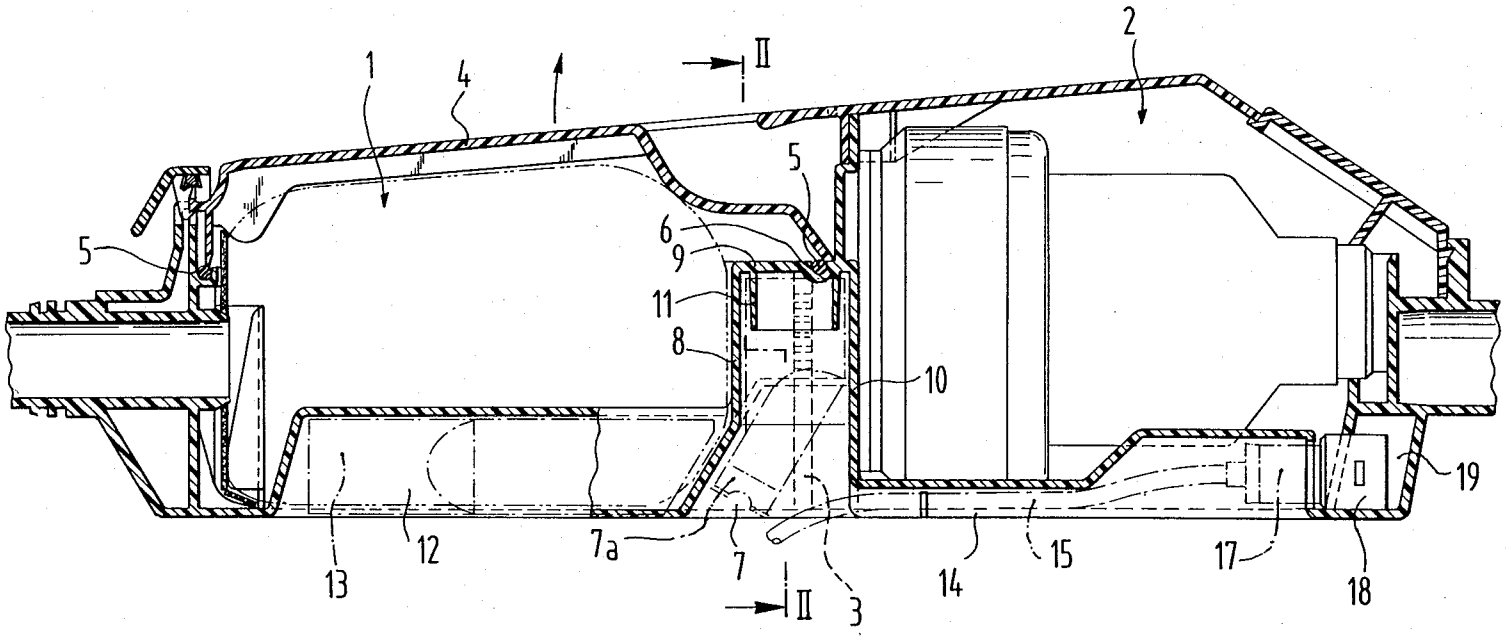

Vacuum cleaners, particularly household vacuum cleaners, are commonly used with several accessory parts, such as various nozzles and brushes, each of which is provided for a definite vacuum cleaning operation. Since, however, these nozzles often are used only if they are immediately available, the nozzle should conveniently be carried along at or in the vacuum cleaner housing to be instantly ready to hand. Moreover the vacuum cleaner may be provided with a carpet brush having its own electrical drive which may be connected with an electrical connection of the vacuum cleaner by means of a cable.

Such vacuum cleaners are disclosed as floor vacuum cleaners e.g. in West German Pat. No. 1628702, which describes a square-stone-shaped housing of a floor vacuum cleaner having at its bottom side a recess for receiving the reeled suction hose and further having a second cavity for receiving a mouth-piece. The chamber for receiving the mouth-piece is disposed on that side of the dust collector chamber which is averted from the motor. By this disposal the design of the vacuum cleaner becomes very long and thus unwieldy, which is however of minor importance when the floor vacuum cleaners are provided with wheels. For use in hand vacuum cleaners, however, this arrangement is less suitable as hand vacuum cleaners should be compact and handy. Beyond that the baffle between the chamber for receiving the mouth-piece and the dust collector chamber is made in two pieces and also has undercuts, as for reasons of die casting techniques it is hard to prepare it as one piece with the housing. Thus, this housing shape requires at least two different die moulds or one single, but complicated one. In any event the production requires high expenditures and is thus expensive.

Another embodiment of a floor vacuum cleaner is described in West German Pat. No. 1628685. This prior art reference describes a floor vacuum cleaner comprising a cavity lying in the housing wall above the dust collector, the purpose of said cavity being to receive the most used suction nozzle. Further suction nozzles are mounted into this cavity in a common fixture, thus destroying the smooth surface shape of the housing and entailing the risk that the fixture becomes entangled in the cable of the vacuum cleaner or is caught by the edge of a piece of furniture, thus being damaged. Moreover, such a fixture is not suitable for use in hand vacuum cleaners since by quick back and forth movement and the resulting constantly changing inclination of the vacuum cleaner in operation the fixture would be catapulted away.

Either of the above-described vacuum cleaner designs has above all the disadvantage that the air-permeable baffle between the dust collector chamber and the suction motor is made plane so that the dust collector can stick to the wall, whereby the suction effect is no longer distributed throughout the entire dust collector but is reduced to those areas of the dust collector which are adjacent to the openings of the baffle. Thus, there is hardly any air sucked off into the dust collector chamber through the areas of the dust collector which are far from the baffle, so that the receiving capacity of the dust collector is not entirely utilized.

It is therefore the object of the invention to provide an appropriate housing for a hand vacuum cleaner, which housing is compact, comprises as few parts as possible and allows a complete utilization of the capacity of the dust collector.

According to the invention this object is achieved by the features shown in claim 1.

The bottom portion of the housing is made as one piece and without any undercuts so that its production is simple and inexpensive. According to the invention it has cavities, into which the accessory parts may be easily inserted from outside in a manner that they are completely received by said cavities. Thus the aesthetically attractive shape of the hand vacuum cleaner may be retained. Moreover, when using the vacuum cleaner the smooth outer surface of the housing prevents the vacuum cleaner from being entangled at furniture edges, curtains and the like.

According to the invention a first cavity in the housing is provided by a stowage chamber for a nozzle, which stowage chamber is arranged between the front dust chamber and the rear motor chamber of the housing and which is open to the bottom side of the housing; i.e. a clearance, which is anyhow existing also in common vacuum cleaner housings, is enlarged and from the technical point of view provided for the purpose of forming the section of the endless seal groove extending in this area. This has the advantage that the stowage chamber of the nozzle may practically be made without special additional expenditures such as undercuts, additional die moulds or other parts, because it is only an already existing clearance which is made utilizable by enlargement thereof.

The air flow through openings in the baffle between the dust chamber and the motor chamber are suitably arranged at either side of the stowage chamber, and according to the invention the baffle having the air flow through openings is displaced backward from the front wall of the stowage chamber towards the motor chamber. This design has the advantage that the dust collector inserted in the dust chamber cannot stick to the air flow through openings, thus allowing an even distribution of the suction effect around the entire dust collector and providing a considerably better utilization of the capacity.

Suitably the stowage chamber has substantially the form of the nozzle to be received, the dimensions being somewhat enlarged. This allows to introduce the nozzle easily into the storage chamber without any unused room being left. Suitably at the upper wall of the stowage chamber there is arranged an annular, upward conically expanding projection extending towards the bottom side, which projection is provided for mounting the nozzle. Thus the invention provides a particularly simple possibility for mounting the nozzle.

The stowage chamber may essentially have the form of an upholstery nozzle for housing therein the frequently used upholstery nozzle.

Suitably in the bottom area of the dust chamber there may be provided a second stowage chamber for receiving another nozzle, said second stowage chamber extending in the longitudinal direction of the dust chamber. Due to its particular form this would be particularly suitable for the longitudinal joint nozzle which is also required for almost every vacuum cleaning operation.

Further it proves to be useful to arrange a channel for receiving an electrical junction cable for a carpet brush, said channel extending in the bottom area of the motor chamber in the longitudinal direction thereof, being open to the bottom side and leading to the stowage chamber. In this way another accessory part, namely the electrical junction cable for a carpet brush, may be received in the housing according to the invention. In the channel there is arranged at least one pair of jaws lying opposite to each other for jamming the cables therebetween. In this way the cable is safely fixed inside the housing and does not disturb the vacuum cleaning operation.

Suitably in a recess of the motor chamber, which recess follows the channel, there is arranged a socket for a plugging-in connection of the cable in axial alignment to the channel. This embodiment has the advantage that the plug may be introduced into the socket from below and is immerged in the housing, thus imparting to the vacuum cleaner housing a more attractive outward appearance without requiring spark plugs and complicated cable guidances.

Further features, advantages and details of the invention will become evident from the following description of the preferred embodiment as well as from the drawing.

Figure 2:
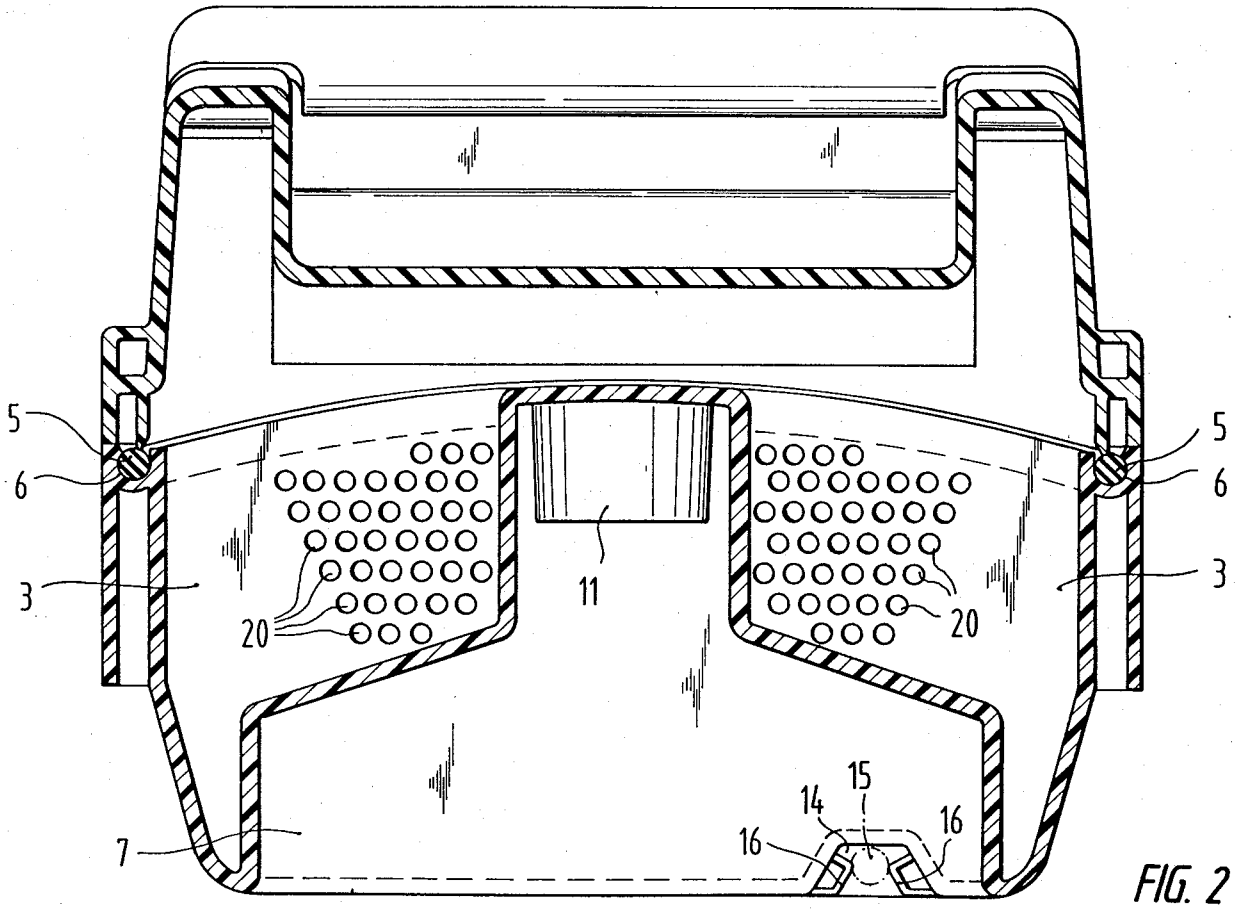

FIG. 1 shows a longitudinal cross-section through the vacuum cleaner housing according to the invention, and FIG. 2 shows a cross-section along the line II—II in FIG. 1.

The housing for a hand vacuum cleaner as shown in FIGS. 1 and 2 comprises a front dust chamber 1 and a rear motor chamber 2, which are separated by a baffle 3. Cover 4 of dust chamber 1 is capable of being swung in the direction of an arrow shown in FIG. 1 and is in the closed state hermetically connected with the bottom portion of dust chamber 1 by means of an endless seal 5 which is placed into a circumferential groove 6.

Between the dust chamber 1 and the motor chamber 2 there is provided a stowage chamber 7 for receiving an upholstery nozzle *7a*. Said stowage chamber 7 comprises a front side wall 8, an upper wall 9, wherein there is provided a section of the circumferential groove 6, and a rear wall 10. Stowage chamber 7 is opened towards the bottom side of the housing and, as will become evident particularly from FIG. 2, has a form which corresponds to the form of the upholstery nozzle to be received. At the upper wall 9 of the stowage chamber there is arranged an annular, upward conically expanding projection 11 extending towards the bottom side said projection being provided for mounting the upholstery nozzle which is to be received by stowage chamber 7.

In the baffle 3 between the dust chamber 1 and the motor chamber 2 there are arranged air flow-through openings 20 connecting dust chamber 1 with motor chamber 2. Since the baffle 3 containing the air flow-through openings is displaced backward from the front wall 8 of stowage chamber 7, a dust collector 21 cannot stick to the air flow-through openings 20 and thus not block them, so that an even distribution of the suction effect in the dust chamber can be provided.

In the bottom area of dust chamber 1 there is further arranged a longitudinally extending second stowage chamber 12 for receiving a joint nozzle 13.

In the bottom are of motor chamber 2 the vacuum cleaner housing further has a channel 14 for receiving an electrical junction cable 15 for a carpet brush, said channel being open towards the bottom side and leading into the stowage chamber 7. In channel 14 there is arranged a pair of jaws 16 lying opposite to each other for jamming cable 15 therebetween. In the area of the rear end of motor chamber 2 the depth of channel 14 increases in a way that a plug 17 of the electrical junction cable 15 may be comfortably led inside the channel and inserted in a socket 18 which is arranged in a recess 19 which follows channel 14.

We claim:

1. A housing for a vacuum cleaner, comprising a front dust chamber and a rear motor chamber, which are connected with each other by air flow-through openings in a baffle, further comprising a dust chamber cover swingably arranged near the baffle, an endless seal circumferentially arranged at the housing between the housing and the dust chamber cover and a stowage chamber for at least one accessory part, characterized in that said stowage chamber (7) is formed in the bottom side of the housing by a cavity made in the housing wall, said cavity being provided for formfit holding of the accessory part and its longitudinal dimension being arranged perpendicular to the longitudinal axis of the housing, and further characterized in that the stowage chamber (7) is integrated in the baffle (3) and at least partially projects into said dust chamber (1), and that a portion of said endless seal (5) extends along an upper wall (9) of said stowage chamber (7).

2. A housing according to claim 1, characterized in that on the upper wall (9) of said stowage chamber (7) there is arranged an annular, upward conically expanding projection (11) extending towards the bottom side which projection is provided for mounting said accessory part (*7a*).

3. A housing according to claim 1 or 2, characterized in that a recess is defined by a channel (14) for receiving an electrical junction cable (15) for a carpet brush, said channel extending in the bottom area of said motor chamber (2) in the londitudinal direction thereof, being open towards the bottom side, and leading into said stowage chamber (7).

4. A housing according to claim 3, characterized in that in said channel (14) there is arranged at least one pair of jaws (16) lying opposite to each other for jamming said cable (15) therebetween.

5. A housing according to claim 3, characterized in that in a recess (19) of said motor chamber (2) adjacent said channel (14) there is arranged a plug (18) for the plugging-in connection (17) of said cable (15) in axial alignment to said channel (14).

6. A housing according to claim 4, characterized in that in a recess of said motor chamber adjacent said channel, there is arranged a plug for the plugging-in connection of said cable in axial alignment to said channel.

* * * * *